United States Patent [19]

Milligan

[11] Patent Number: 4,762,297

[45] Date of Patent: Aug. 9, 1988

[54] METHOD AND APPARATUS FOR TEMPORARILY STORING HOUSEHOLD WASTE

[76] Inventor: Dale Milligan, 25900 Camino Juarez, Sun City, Calif. 92381

[21] Appl. No.: 66,304

[22] Filed: Jun. 25, 1987

[51] Int. Cl.[4] ..... B65B 67/04

[52] U.S. Cl. ..... 248/99; 248/100

[58] Field of Search ..... 248/95, 97, 99, 100, 248/101, 175, DIG. 7, 339; 232/1 B; 211/12, 71; 220/404

[56] References Cited

U.S. PATENT DOCUMENTS

| | | | |
|---|---|---|---|
| 2,894,708 | 7/1959 | Kaplan | 248/99 |
| 3,391,698 | 7/1968 | Wiles | 248/99 X |
| 3,391,891 | 7/1968 | Garden | 248/339 X |
| 4,332,361 | 6/1982 | McClellan | 248/99 X |
| 4,398,689 | 8/1983 | Prader | 248/99 |
| 4,418,835 | 12/1983 | Watts | 248/100 X |
| 4,458,867 | 7/1984 | Malik | 248/99 X |
| 4,498,652 | 2/1985 | Malik | 248/99 |
| 4,579,307 | 4/1986 | Malik | 248/99 |
| 4,669,689 | 6/1987 | Jones | 248/99 |

*Primary Examiner*—Ramon O. Ramirez

*Attorney, Agent, or Firm*—Charles H. Thomas

[57] ABSTRACT

A pair of hangers are employed to support and hold open a plastic grocery bag to reuse the grocery bag as a trash bag. The hangers are each formed of a pair of upright standards and a laterally extending stretching rack bounded at opposite ends by the upright standards. The stretching rack is of a length suitable to receive a handgrip loop of a plastic grocery bag so that the upright standards hold the loop stretched across the stretching rack. The hangers are mounted on opposite ends of the rim of a waste container or upon a vertical support in horizontally spaced separation from each other so that the plastic grocery bag is suspended from and held open by the hangers for reuse as a trash bag.

4 Claims, 1 Drawing Sheet

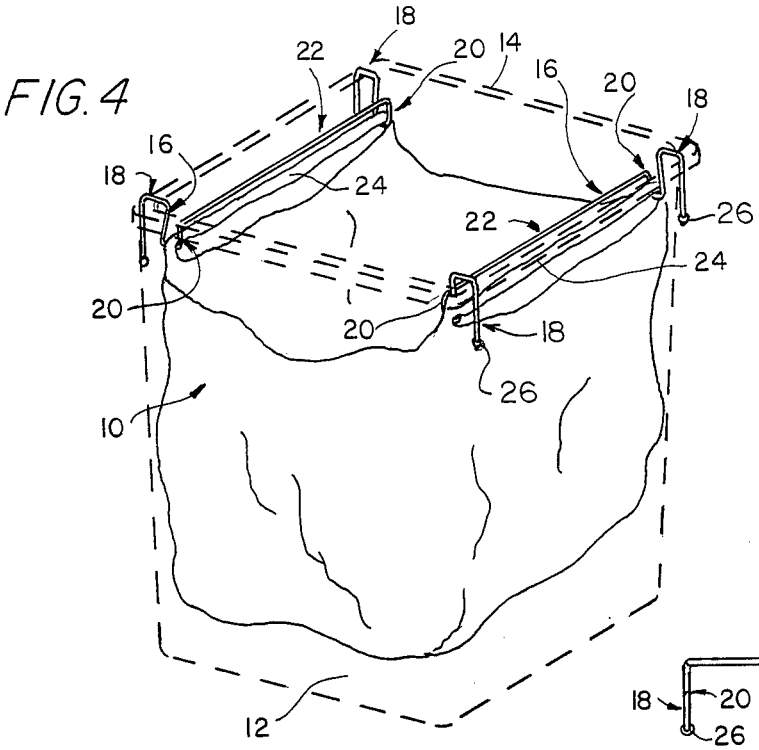
FIG. 4
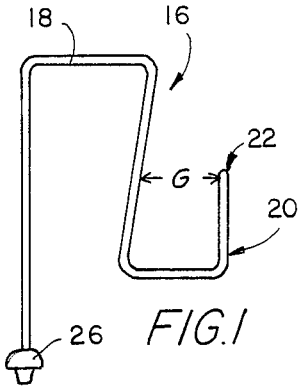
FIG. 1
FIG. 2
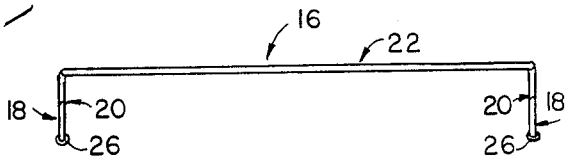
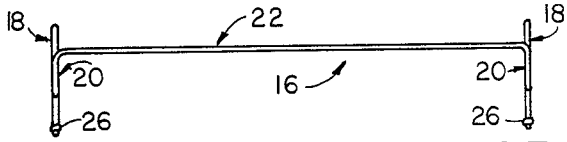
FIG. 3
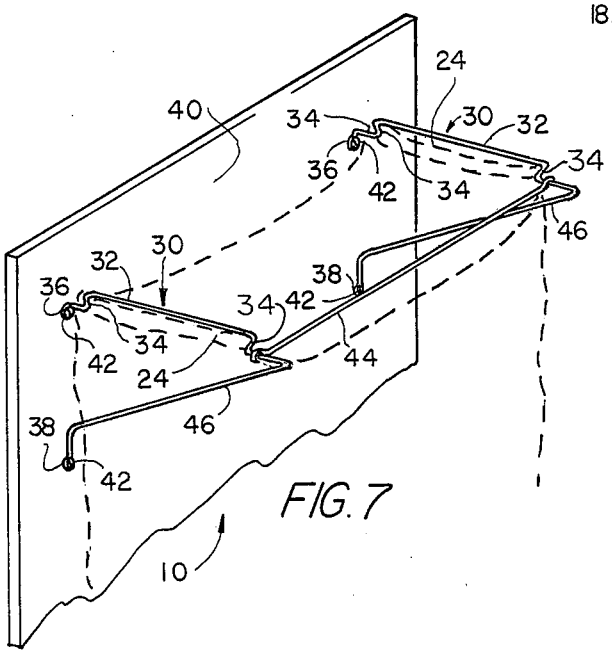
FIG. 7
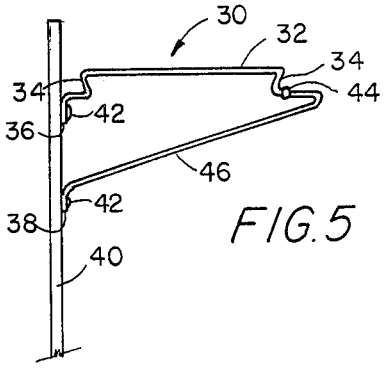
FIG. 5
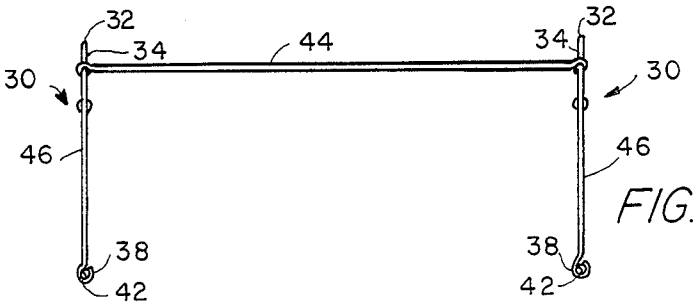
FIG. 6

METHOD AND APPARATUS FOR TEMPORARILY STORING HOUSEHOLD WASTE

BACKGROUND OF THE INVENTION

1. Field of the Invention

The present invention relates to a method and apparatus for reusing conventional plastic merchandise carrying bags, such as plastic grocery bags, as waste receptacle liners and as hanging trash bags.

2. Description of the Prior Art

For many years grocery stores and other retail merchandise outlets which sell small, consumer items, have typically employed checkout clerks and other personnel who place articles purchased by a customer in one or more paper sacks. Numerous odd shaped items can be placed in such paper sacks to allow the customer to carry items of purchase within such sacks from the retail establishment. The use of such sacks serves the basic purpose of providing the customer with a sack in which numerous, small, odd shaped items can easily be transported from the retail establishment.

Conventional sacks which have been provided for this purpose are constructed of relatively heavy brown paper which will not tear apart even if used to carry relatively heavy items of purchase. At the checkout counter or at a cashier's position a checker or cashier places each of the articles of purchase in paper bags of the types described following tabulation of the cost of the articles of purchase. The use of such paper bags has facilitated the transportation of numerous, small items purchased from a retail establishment to the home of a purchaser. The sacks are typically carried by hand or in a shopping cart from a retail sales establishment and loaded into the back seat or trunk of a vehicle, such as an automobile. Once the consumer returns to his or her dwelling, the sacks are unloaded from the vehicle and carried by hand into the dwelling. Once inside the dwelling the articles purchased are unpacked and stored in their appropriate locations. At this point the sacks have completed their primary useful function.

The paper sacks used to transport groceries and other articles purchased for household consumption are relatively stiff, since they must be able to transport relatively heavy items without tearing. Although paper sacks of this type were not intended for reuse when provided by the grocery and other retail establishments to consumers, consumers soon discovered that these paper sacks could serve a secondary function as receptacles for waste materials. While the paper sacks are not rigid and can be readily folded, they are constructed of paper stiff enough so that the sacks, once opened, will remain open. Thus, the paper sacks provided by grocery stores and other retail merchandise establishments, once transported by the consumer to the dwelling of the consumer, have frequently been reused as trash can and waste basket liners. That is, the user would open the sack and position the sack upright within a waste basket or waste can. The surrounding walls of the waste basket or waste can provided a secure enclosure for waste materials, while the paper sack served as a convenient liner. When enough waste material had been placed in the sack, it could be removed from the waste basket or waste can and discarded.

In recent years grocery markets and other retail establishments have increasingly been converting from using paper sacks of the type described to thin, plastic sacks for transporting groceries and other consumer merchandise. Such thin plastic sacks may be purchased by retail establishments more economically than the earlier brown paper sacks. Moreover, the thin plastic sacks weigh considerably less and occupy considerably less volume than an equivalent number of paper sacks. Despite their light weight the plastic sacks are quite strong and will not tear or rip even when loaded with relatively heavy articles of purchase.

Because the plastic sacks are so light in weight, they do not hold their shape, as do paper sacks. As a consequence, the plastic sacks are each manufactured with a pair of loops which serve as carrying handles or straps at opposing, upper edges of the sacks. The loops or straps define opposing openings at the upper edge of the plastic sack and are easily gripped by the hand of a user. That is, the user places the fingers of one hand through both of the loops at the top of the sack and carries the sack by these loops. The handgrips, when juxtaposed together within the hand of a user, serve as a convenient handle for carrying the sack. Moreover, by holding both loops at the upper edges of opposite sides of the sack together, a user ensures that the mouth of the sack is at least partially closed while the sack is being transported. This reduces the likelihood that any articles of purchase will spill from the sack as it is carried.

While the thin, polyethylene plastic grocery and merchandise bags of the type described perform their primary function at least as well as the prior paper sacks, there has heretofore been no way of using these plastic sacks for a secondary function as a trash bag or waste receptacle liner once the plastic sacks have served their primary function as a means for carrying groceries and other articles of merchandise from a retail establishment to the dwelling of a consumer. Many consumers, who have relied upon the conventional paper sacks as a source of supply of trash bags and waste receptacle liners have thus been left without a source of supply of such items when shopping at a retail establishment which has converted from paper to plastic sacks. As a consequence, many consumers have indicated a strong preference for the paper sacks which they have historically used as trash bags and waste receptacle liners. Thus, retail establishments have, in many cases, been forced to offer the alternative of the more traditional paper sacks when a consumers expresses a preference for such sacks over the more economical plastic sacks. Retailers have therefore been faced with both the expense and inconvenience of maintaining supplies of two different types of sacks for transporting articles of consumer merchandise from their establishments.

The very thin, polyethylene plastic sacks which are now widely utilized for carrying groceries and other articles of merchandise have heretofore been incapable of serving as trash bags and waste receptacle liners. The thin, lightweight structure of these plastic sacks is such that the bags will not stand freely in any manner, either unsupported or supported by the walls of a surrounding waste receptacle. To the contrary, the structure of the plastic sacks immediately collapses and the mouths of the plastic bags will not remain open to receive waste materials.

SUMMARY OF THE INVENTION

The principal object of the present invention is to provide a secondary use for an article of manufacture which is almost invariably discarded once it has performed its primary useful function. Specifically, the present invention provides a use for plastic sacks which are provided by merchandise establishments to consumers for carrying articles purchased by the consumers. According to the present invention, these plastic sacks do not need to be immediately discarded once the purchases carried in them have been unloaded, but rather are reused for temporarily storing household waste, such as waste papers, rubbish, and other articles which are discarded.

Another object of the invention is to provide consumers with a source of supply of articles which can be used as trash bags and waste receptacle liners without the necessity for purchasing such articles especially for that use. To the contrary, consumers are provided with waste disposal sacks as an incidental benefit of purchasing merchandise which is carried in such sacks from a retail establishment.

In one broad aspect the present invention is an apparatus for holding a plastic merchandise carrying bag, such as a grocery bag, as an open waste disposal sack. The invention is comprised of a pair of hangers, each formed of a pair of upright standards and a laterally extending stretching rack bounded at opposite ends by the upright standards. The stretching rack has a length suitable to receive a handgrip loop of a plastic merchandise carrying bag so that the upright standards hold the loop stretched across the stretching rack. Mounting means are provided for holding the hangers in spaced separation from each other with the stretching racks of the hangers disposed parallel to and separated from each other.

In one very useful embodiment of the invention each hanger is comprised of a single length of stiff wire, and the stretching racks are formed of intermediate portions of these stiff lengths of wire bent at both ends to merge into the upright standards. The intermediate portions which serve as the stretching rack of each length of wire are preferably about 7.5 inches in length. This length is short enough so that a handgrip loop of a plastic merchandise carrying bag can be stretched on the stretching rack and held between the two upright standards. The length of the stretching rack is great enough so that the loops are stretched taught, thereby pulling the upper edge of the sack adjacent the loop close to the hanger. Since the hangers are disposed parallel to and separated from each other, this ensures that the mouth of the sack will be pulled open by the hangers.

The system of the invention may be utilized to support a plastic sack designed for carrying consumer merchandise, following use of the sack for that primary purpose, as either a waste receptacle liner or as a hanging trash bag. When the device of the invention is used to support a grocery bag as a waste receptacle liner, the mounting means employed are preferably hooks formed by bending both terminal extremities of each of the lengths of wire. The hooks fomed by the terminal extremities are adapted to fit over the upper edge of a rim of a waste container. The two hangers can be hung by their hooks on opposite sides of the upper rim of a waste basket or waste can having a rectangular opening, as well as on opposite sides of such a waste basket or waste can with a circular opening. As long as the hangers are maintained in spaced separation from each other the mouth of the plastic sack will be held open.

In another arrangement employing a different embodiment of the invention the hangers may be used to suspend a plastic sack for transporting merchandise in a freely hanging condition. For example, the mounting means for the hangers may take the form of fastening eyes located at opposite ends of each of the lengths of wires. The fastening eyes may be specially adapted for securement to a vertical supporting surface, such as the inside of a kitchen cabinet door or the inside of closet door. In such an embodiment the hangers are disposed parallel to each other in horizontal alignment and extending outwardly from the supporting surface in cantilevered fashion. To steady the remote, cantilevered extremity of the hangers a transverse stabilizing brace may be employed to extend between each of the hangers remote from the fastening eyes. Such a brace aids in establishing a predetermined distance of separation between the hangers.

In another broad aspect the present invention may be considered to be a method of temporarily storing household waste utilizing plastic merchandise carrying sacks, each of which is formed of a pair of loops defining carrying handles. According to the method of the invention each of the loops is supported on a hanger formed of laterally extending stretching means bounded at opposite ends by upright standards and having mounting means for holding the hangers in spaced separation from each other. The mounting means are secured to a support so that the laterally extending stretching means are held parallel to each other and in spaced separation from each other. Each loop of a plastic sack is engaged on a separate one of the stretching means, whereby each sack is held suspended between the hangers with each of the loops held by the upright standards of a separate one of the hangers.

The invention may be described with greater clarity and particularity by reference to the accompanying drawings.

DESCRIPTION OF THE DRAWINGS

FIG. 1 is a side elevational view of one embodiment of a hanger according to the invention.

FIG. 2 is a top plan view of the hanger of FIG. 1.

FIG. 3 is a front elevational view of the hanger of FIG. 1.

FIG. 4 illustrates the manner of use of a pair of the hangers of FIG. 1.

FIG. 5 is a side elevational view illustrating an alternative embodiment of the hanger according to the invention.

FIG. 6 is a front elevational view of the hanger of FIG. 5.

FIG. 7 is a perspective view illustrating a pair of the hangers of FIG. 5 as utilized according to the invention.

DESCRIPTION OF THE EMBODIMENTS AND IMPLEMENTATION OF THE METHOD

FIG. 4 illustrates one embodiment of an apparatus for supporting a plastic merchandise carrying bag or sack, such as the polyethylene plastic grocery bag 10. The grocery bag 10 is supported from the rim of a hollow, generally rectangular waste container 12, indicated in phantom. The waste container 12 may, for example, be a molded plastic waste basket or waste can. The waste basket 12 is open at the top and has an outwardly turned rim 14 defined at its open upper extremity.

The apparatus of the invention is comprised of a pair of identical hangers 16. Each of the hangers 16 is formed with a pair of hooks 18 which are adapted to fit over the upper edge of the rim 14 of the waste container 12. Each hanger 16 has a pair of upright standards 20 connected to the hooks 18, and a rigid stretching means in the form of a stretching bar or rack 22 arranged to hold the upright standards 20 in each hanger 16 apart a predetermined distance suitable to receive and stretch a handgrip loop 24 of the plastic grocery bag 10 between the upright standards 20. The upright standards 20 of each hanger 16 hold the loop 24 stretched across the stretching rack 22. The hooks 18 serve as means for holding the hangers 16 in spaced separation from each other on opposite sides of the rim 14 with the stretching rack 22 of the hangers 16 disposed parallel to and separated from each other, as depicted in FIG. 4.

FIGS. 1, 2 and 3 illustrate the construction of each hanger 16. As illustrated, each hanger 16 is formed of a single length of stiff, steel wire, perhaps one eighth of an inch in diameter. The ends of the wire of each hanger 16 are bent to form a pair of hooks 18, which are of an inverted J-shaped configuration and which are parallel to each other as depicted in FIGS. 2 and 3. The upright standards 20 and the stretching rack 22 maintain the hooks 18 of each hanger 16 in spaced separation from each other. The upright standards 20 are formed by bends in the wire which are proximate to the hooks 18 and in mutually coplanar relationship with the hooks 18. The central portion of the wire extends between the upright standards 20 in perpendicular disposition relative thereto to form the rigid stretching rack 22. The terminal extremities of the ends of each length of wire are provided with resilient, rubber caps 26 which serve to prevent the metal ends of the hooks 18 from creating scratches or gouges, and to prevent the wire extremities of the hangers 16 from causing injury.

The length of the central portion of the wire forming the stretching rack 22 is quite important, since the stretching rack 22 must be short enough to receive the handgrips 24 thereover, but long enough to maintain the handgrips 24 in a stretched condition. Commercially available merchandise carrying bags are manufactured in standardized sizes having handgrips of predetermined lengths. The most popular size of such a merchandise carrying bag is a polyethylene sack, which when flattened with pleats folded inwardly has measurements of approximately twelve inches across the bottom and top by about sixteen and three-quarter inches along the sides between the top and the bottom edges. The loops forming the handles are each approximately eleven inches in length as measured from separate junctions with the top edge. Plastic merchandise carrying bags of this type are widely used as grocery bags in many retail supermarkets. One such plastic grocery bag is marketed under the registered trademark Sonoco in Santa Maria, Calif.

To support a plastic grocery bag 10 of the type described, the stretching rack 22 formed by the central portion of the wire from which the hanger 16 is manufactured is preferably about 7.5 inches in length. This length is short enough so that the loops formed by the handgrips 24 will pass over the bends in the wire of the hanger 16 forming the demarcations between the stretching rack 22 and the upright standards 20. However, the length of the stretching rack 22 is long enough so that the handgrips 24 are stretched and tend to pull the upper edge of the bag 10 adjacent thereto into close proximity to the hanger 16. Since the hangers 16 are maintained in spaced separation from each other, stretching of the handloops 24 in this manner tends to pull the opposite upper edges of the grocery bag 10 adjacent thereto away from each other, thereby holding the grocery bag 10 fully open as despicted in FIG. 4.

Preferably also, the upright standards 20 are separated from the hooks 18 at both ends of the central portion of the wire forming the stretching rack 22 by a gap of about one-quarter of an inch in width. Such a gap is indicated at G in FIG. 1. This gap is sufficient to allow the handloops 24 to pass between the stretching rack 22 and the hooks 18, but is sufficiently narrow so that the loops 24 are unlikely to be inadvertently pulled out through the gap, except when a force is purposely exerted for this purpose at the time the grocery bag 10 is filled with waste material and is to be discarded.

FIG. 4 illustrates the manner in which the method of the invention is implemented. As illustrated, each of the loops 24 of the grocery bag 10 are supported on a separate hanger 16, each of which is formed of a laterally extending stretching rack 22 bounded at opposite ends by upright standards 20. The mounting hooks 18 at the ends of the wire structure forming the hangers 16 are placed over and secured to opposite sides of the rim 14 of the waste basket 12 so that the laterally extending stretching racks 22 are held parallel to and in spaced separation from each other. Each loop 24 of a plastic grocery bag or sack 10 is placed on a separate one of the stretching racks 22, whereby the plastic grocery sack 10 is held suspended between the hanger 16 with each of the loops 24 held by the upright standards 20 of the hangers 16.

In FIG. 4 the mounting means for each of the hangers 16 is comprised of a pair of hooks 18 and the support is the rim 14 at the mouth of the waste basket 12. The hooks 18 of each hanger 16 are placed over the rim 14 of the waste basket 12 on opposite sides thereof so that the plastic sack 10 is suspended from and held open by the hangers 16 within the cavity of the waste basket 12.

FIGS. 5 through 7 illustrate an alternative embodiment of the invention employing a pair of hangers 30. Like the hangers 16, each of the hangers 30 is comprised of a single length of stiff, steel wire and the stretching racks 32 are formed of intermediate portions of the stiff lengths of wire bent at the ends to merge into upright standards 34. The stretching racks 32, like the stretching rack 22, are each formed of intermediate portions of each length of wire and are about 7.5 inches in length.

In the embodiment of FIGS. 5, 6 and 7 the mounting means are not hooks, but take the form of fastening eyes 36 and 38 which are formed by loops of the wire at the opposite ends of each of the lengths of wire. The fastening eyes 36 and 38 are adapted for securement to a vertical supporting surface, such as the interior surface of the cabinet door 40 depicted in FIGS. 5 and 7. The fastening eyes 36 and 38 are secured to the interior surface of the cabinet door 40 by means of conventional wood screws 42. The apparatus is completed by a transverse, stablilizing brace 44 which is connected to the cantilevered extremities of the hangers 30 remote from the cabinet door 40.

A grocery bag 10 is hung from the hangers 30 in the same manner as the bag 10 is hung from the hangers 16 in FIG. 4. That is, the handgrip loops 24 of the plastic bag 10 are passed over the stretching racks 32 and are held in a taut stretched condition by the upright standards 34, so that the bag 10 depicted in phantom in FIG. 7, hangs suspended between the hangers 30 as a suspended trash bag on the inside of the cabinet door 40. The inclined portions 46 of the wire structures forming the hangers 30 serve as inclined supporting braces against the weight of waste material which accumulates in the bag 10.

Undoubtedly, numerous variations and modifications of the invention will become readily apparent to those familiar with the temporary storage of household waste material. For example, different types of mounting systems may be employed to secure hangers to different types of supports, such as overhead supports or inclined supports. Accordingly, the scope of the invention should not be construed as limited to the specific embodiments of the invention depicted and the specific implementation of the invention described herein, but rather is defined in the claims appended hereto.

I claim:

1. Apparatus for supporting a plastic merchandise carrying bag from the rim of a waste container comprising a pair of hangers each formed of a single length of stiff wire and wherein the ends of each of said wires are bent to form a pair of hooks disposed parallel to each other and in spaced separation from each other to serve as hook means adapted to fit over the upper rim of a waste container, and each of said hangers has a pair of upright standards connected to said hook means and formed by bends in said wires proximate to said hooks thereof and in mutually coplanar relationship with said hooks thereof, and a central portion of each of said wires extends horizontally between said standards to serve as a rigid stretching means arranged to hold said upright standards in each hanger apart a predetermined distance suitable to receive and stretch a handgrip loop of a plastic merchandising bag between said standards.

2. Apparatus according to claim 1 further comprising resilient caps on said ends of said wire.

3. Apparatus according to claim 2 wherein said central portion of said wire is about 7.5 inches in length.

4. Apparatus according to claim 3 wherein said upright standards are separated from said hooks at both ends of said central portion of said length of wire by a gap about one quarter of an inch in width.

* * * * *